US005916092A

United States Patent [19]

Chen

[11] Patent Number: 5,916,092

[45] **Date of Patent: *Jun. 29, 1999**

[54] RAIN GUTTER COVER

[76] Inventor: Jay Chen, 510 Rancho Bauer, Houston, Harris County, Tex. 77079

[ * ] Notice: This patent is subject to a terminal disclaimer.

[21] Appl. No.: 09/028,200

[22] Filed: Feb. 23, 1998

Related U.S. Application Data

[63] Continuation of application No. 08/749,053, Nov. 14, 1996, Pat. No. 5,755,061.

[51] Int. Cl.[6] ..... E04D 13/64

[52] U.S. Cl. ..... 52/12; 52/11; 210/162; 210/477

[58] Field of Search ..... 52/11, 12; 210/162, 210/459, 473, 474, 477

[56] References Cited

U.S. PATENT DOCUMENTS

| | | | |
|---|---|---|---|
| 2,674,961 | 4/1954 | Lake | 52/12 X |
| 2,935,954 | 5/1960 | Matthews et al. | 52/12 X |
| 3,864,267 | 2/1975 | Nelems | 52/12 X |
| 4,590,716 | 5/1986 | Smith | 52/12 |
| 4,667,448 | 5/1987 | Smith | 52/12 |
| 4,745,710 | 5/1988 | Davis | 52/12 |
| 5,332,332 | 7/1994 | Kenyon, Jr. | 52/12 X |
| 5,755,061 | 5/1998 | Chen | 52/12 |

FOREIGN PATENT DOCUMENTS

| | | | |
|---|---|---|---|
| 2640661 | 6/1990 | France | 52/12 |

*Primary Examiner*—Carl D. Friedman
*Assistant Examiner*—Kevin D. Wilkens
*Attorney, Agent, or Firm*—Browning Bushman

[57] ABSTRACT

A rain cover 10 prevents leaves and other debris from plugging a conventional gutter G, while rain water from the roof of a building is transmitted to the gutter by surface tension. The cover includes a main plate 14 inclined for allowing water and debris to pass by gravity from an upper portion 30 to a lower portion 32. A front portion 16 of each of a plurality of traversely spaced fins 14 extend laterally beyond an outer wall of the gutter. Pairs of adjacent fins 14 are separated by a uniform traverse gap of less than 0.05 inches to significantly increase the return of water to the gutter by surface tension with the fin walls. The cover may be economically manufactured from plastic or metal, and may be easily installed on an existing gutter system. The separation device of the present invention may be used in other applications to separate solid debris from a fluid.

16 Claims, 5 Drawing Sheets

RAIN GUTTER COVER

This application is a continuation of application Ser. No. 08/749,053 filed on Nov. 14,1996, now U.S. Pat. No. 5,755,061.

FIELD OF THE INVENTION

The present invention relates to devices for automatically separating a liquid from solid matter contained therein. More particularly, this invention relates to a cover for a rain gutter which reliably collects water within the gutter while allowing leaves and other solid debris to bypass the gutter and fall to the ground. The rain gutter cover accordingly keeps the gutter free of debris which normally plug the gutter while allowing rain water to pass through the gutter and downspout system.

BACKGROUND OF THE INVENTION

Many houses and other buildings are provided with rain gutters at the edge of the building to collect rain water from the roof of the building. Gutters prevent water from falling off the roof and dropping onto flower beds or plants commonly provided adjacent the building, thereby minimizing damage to the plants. The gutter normally channels the rain which falls on the roof to a downspout, which then discharges the water at a location which typically results in the rapid flow of water to a municipal storm system, thereby also minimizing flooding adjacent the building.

Those familiar with gutters have long recognized that conventional rain gutters work well in areas where the vegetation is lower than the elevation of the gutters, but that gutters typically plug with leaves and pine needles in locations with large trees. Also, balls and other toys may become lodged in a gutter, effectively obstructing normal rain water flow through the gutter system. Numerous types of gutter coverings have thus been proposed for alleviating these problems, although no prior art gutter cover has been particularly successful. Accordingly, homeowners frequently still spend weekends cleaning debris out of rain gutters. Unfortunately, many individuals do not possess the desired equipment or are inexperienced with safety procedures, and often fall or hurt themselves performing this cleaning operation.

Various types of gutter covers have been proposed over the last hundred years. Numerous devices are intended to function only in conjunction with a specially made gutter, and thus have limited acceptance since most people want a covering which will operate with their existing, relatively inexpensive gutter system. U.S. Pat. No. 546,042 discloses a gutter cover used with a gutter not commonly used today, although this cover could be modified for use with a conventional gutter. A gutter cover that extends partially under the lower edge of the roofing material and terminates prior to the outward edge of the gutter is disclosed in U.S. Pat. No. 4,455,791. Clips or straps interconnect the forward edge of the cover with the outer portion of the gutter. Leaves may thus become trapped between the forward edge of the cover and the gutter. A lower edge of the cover curls downward, and water follows the curvature to drain into the gutter. As with other types of gutter covers, leaf buildup within the gutter may be minimized by using these devices, although the horizontal or lateral spacing between the forward edge of the cover and the exterior edge of the gutter still allows leaves and other debris to fall into the gutter. Also, leaves may become easily trapped between the forward edge of the cover and the gutter, thereby blocking normal flow of water into the gutter. Accordingly, these types of covers functionally are similar to a mesh covering which allows water to fall through small holes and into the gutter, while leaves pass over the mesh and fall to the ground. Mesh-type gutter covers have been used, although leaves often become trapped on top of the mesh so that rain water passes over the trapped leaves and does not drop into the gutter.

Various gutter covers project laterally from the side of the building so that the forward edge of the cover is at or extends laterally beyond the outer edge of the gutter, thereby preventing leaves or other debris from falling into the gutter. Rain water may be returned toward the building and thus fall into the gutter by a lower inclined portion of the, covering, utilizing surface tension to return the water back toward the building and into the gutter. U.S. Pat. No. 891,405 discloses a gutter covering of this type, with holes in the lowermost portion of the gutter cover allowing water to drop into the gutter. Surface tension is also used to return water toward the building and thus into the gutter in U.S. Pat. No. 2,669,950, although the specially made gutters illustrated in this patent are positioned entirely beneath the roof overhang of the building. A plurality of spaced apart ribs may be used for preventing leaves from adhering to the inclined lower surface of a cover, while surface tension transmits the rain water to the gutter. U.S. Pat. No. 4,757,649 discloses a gutter cover which also relies upon surface tension to return water to the gutter, and optionally include raised ribs to lift the leaves off the planar surface of the gutter to increase the likelihood of the leaves promptly falling to the ground. U.S. Pat. No. 5,406,755 discloses yet another type of gutter cover which relies upon surface tension to return water to the gutter. Ridges are used to support the cover on the outer portion of the gutter.

Other types of rain gutter covers utilize various types of ribs to slow down the velocity of water or otherwise divert the water passing into the gutter. U.S. Pat. No. 4,404,775 discloses a rain gutter cover with a plurality of laterally spaced ribs or crowns upstream from the curved portion of the gutter, which relies upon surface tension to return water to the gutter. U.S. Pat. No. 4,416,835 discloses a device for receiving a liquid into an elongate trough, along with ribs for reducing the vertical velocity components of the liquid when it enters the trough. U.S. Pat. Nos. 3,950,951, 4,435,925, 4,667,448, and 5,181,350 each also disclose different types of coverings for rain gutters.

The prior art has long recognized the benefit of a gutter cover which separates rain water from leaves and other debris, allowing the water to drop into the gutter while the leaves and debris fall to the ground. The existing patents do not disclose devices which are in wide use today, primarily because these prior art gutter covers are not effective at fulfilling this function.

The disadvantages of the prior art are overcome by the present invention, and an improved device is hereinafter disclosed for automatically separating a fluid from solid matter within the fluid. The device of the present invention is particularly well suited for use as a gutter cover for directing rain water into the gutter while allowing leaves and other debris to bypass the gutter and fall to the ground.

SUMMARY OF THE INVENTION

The gutter cover of the present invention reliably operates in conjunction with an existing gutter and downspout system. This is a particular advantage of the invention, since the building owner may add a gutter cover to an existing gutter system. Any subsequent replacement of the gutter system, if required, will not require replacement of the gutter cover. The gutter cover is highly effective at depositing rain water into the gutter, while ensuring that leaves and other debris bypass the gutter and fall to the ground.

The gutter cover comprises a main plate which extends from adjacent the building roof to a location above and spaced laterally at the spacing of or laterally outward of an outer edge of the elongate gutter. A plurality of spaced apart vertical plates or fins may be rigidly fixed to the main plate. Each vertical fin may include an upper portion extending from at least midway on the upper surface of the main plate to the and laterally outward edge of the main plate, then beyond the main plate laterally outward of an outer edge of the gutter. A lower portion of each vertical fin may extend from beyond the outer edge of the main plate to below the main plate. A lower surface of the lower portion of each vertical fin is inclined downward and toward the building, and includes a lower edge drop point above the gutter and below the main plate. Leaves pass over the top of the spaced apart vertical fins and drop to the ground. Rain water passes between the vertical fins, with the upper portion of the vertical fins achieving relatively smooth and controlled flow of the rain water. Once passing laterally outward past the outer edge of the main plate, water is returned back toward the building by the lower portions of the fins, and drops into the gutter from the lower edge point.

The spacing between the vertical fins is controlled so that the significant area surface of the sides of the vertical fins functions to return water to the gutter by capillary action. According to preferred embodiments, a uniform spacing between adjoining sides, of the vertical fins results in a gap of less than 0.05 inches between the vertical fins, and preferably from about 0.04 to 0.02 inches. This substantial thin gap between the vertical fins, coupled with the substantial surface area of the vertical fins and the inclined lower surface of the lower portion of the vertical fins, ensures that water is returned to the gutter, while leaves and other debris pass over the vertical fins and drops to the ground.

According to a preferred embodiment of the present invention, the vertical fins extend laterally from the building further than an outward wall of the gutter. Various rib or flow channel diversion members may be provided for reducing the velocity of water traveling between the vertical fins and then into gutter. In another embodiment of the invention, the upper portion of the vertical fins is eliminated, and the vertical fins extend from laterally outward of the main plate and the outward edge of the gutter to below the main plate and above the gutter. The spacing between adjacent sides of the vertical fins is nevertheless controlled, as noted above, to achieve the desired capillary action which returns water to the gutter.

It is an object of the present invention to provide an improved system and device for automatically separating fluid from solid matter carried within the fluid. The device of the present invention relies upon substantially increased surface tension created by close spacing between adjacent fins to direct the fluid in a direction away from the debris which drops over the fins.

Another object of the invention is to provide an improved cover for a rain gutter which reliably collects rain water in the gutter while allowing leaves and other debris to pass by the gutter and fall onto the ground. A related object of the invention is to provide a relatively inexpensive rain gutter cover which will effectively prevent plugging of rain gutters.

It is a significant feature of the invention that the gutter cover may be formed from a variety of materials, including plastic and metal materials. It is a further feature of the invention that the gutter cover may be supported from the building and/or the gutter using a variety of conventional support or securing members. The gutter cover of the present invention may also be used with various types and configurations of gutters, and may be installed for use with an existing gutter system.

It is a significant advantage of the present invention that the gutter cover has a relatively low cost, and may be economically installed for use with an existing gutter system. A related advantage of the invention is that the gutter cover may remain in place while a corroded or bent gutter is replaced with a new gutter.

These and further objects, features, and advantages of the present invention will become apparent from the following detailed description, wherein reference is made to the figures in the accompanying drawings.

DETAILED DESCRIPTION OF THE PREFERRED EMBODIMENTS

Figure 1:
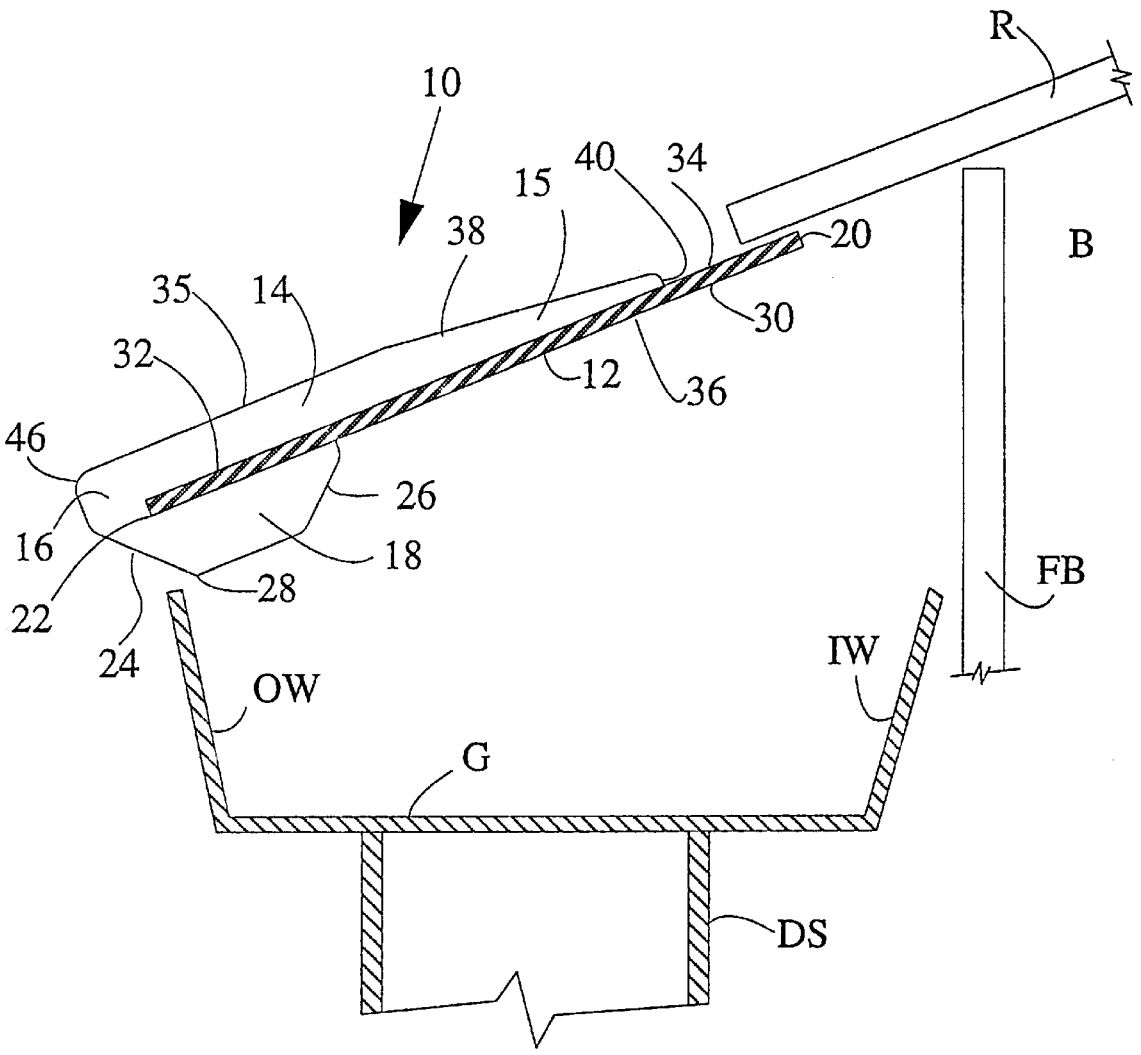
FIG. 1 is a general pictorial view, partially in cross-section, illustrating a gutter cover according to the present invention and installed above a conventional gutter adjacent the side of a building.

A preferred embodiment of the present invention is depicted in FIG. 1. The rain gutter system of this invention may comprise a gutter cover 10 discussed in detail below, and a conventional elongate gutter G secured by spikes (not shown) or other conventional securing members to the facia board FB of a building B having a conventional roof R. The gutter includes an inner wall IW generally adjacent the building, and an outer wall OW spaced laterally outward from the building. The gutter G is inclined for transmitting rain water along the length of the gutter to a common downspout DS.

The rain gutter cover 10 comprises inclined solid planar main plate 12 and a plurality of vertical plates or fins 14 spaced traversely along the length of the main plate. In the application depicted in FIG. 1, the upstream end surface 20 of the main plate is positioned under the overhang portion of the roof R which extends laterally outward from facia board FB. In other applications, the raised or upstream portion of a main plate may be fitted between the shingles of the roof and the roofing board which support the shingles. Conventional securing members discussed subsequently may be used to structurally interconnect the main plate to the roof R, or alternatively to the facia board FB.

Figure 2:
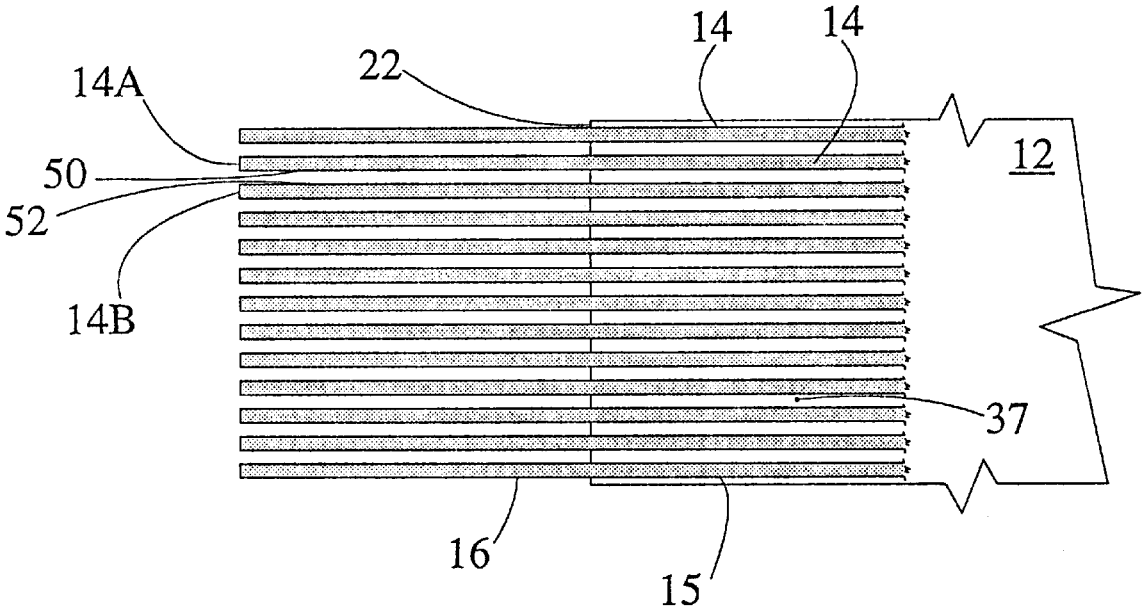
FIG. 2 is a top view of the gutter cover generally shown in FIG. 1.

Referring to FIGS. 1 and 2, each of the vertical plates or fins 14 is rigidly fixed to the main plate 10, and includes an upper portion 15 above the main plate, a front portion 16 extending laterally outward from a downstream end surface 22 of the main plate, and a lower portion 18 below the main plate. The upper portion 30 of tie main plate as shown in FIG. 1 receives the rain water and leaves or other solid debris from the roof The inclination of the main plate as shown in FIG. 1 results in the water and debris passing by gravity to the downstream portion 32 of the main plate. The main plate 12 preferably has a substantially uniform thickness and may be fabricated in lengths of several feet or more to be positioned above a standard width elongate gutter. The upper surface 34 and the lower surface 36 of the main plate each preferably lie within a respective single plane, although the main plate could be curved slightly in a convex direction for increased strength, if desired. The main plate 12 is preferably solid so that leaves and other debris do not become trapped along the main plate. As shown in FIG. 1, the downstream end surface 22 of the main plate is positioned at the same lateral spacing from the building as the upper end of the outer wall OW of the gutter G. Accordingly, if not for the benefit of surface tension as described subsequently, rain water from the roof which passes downward along the main plate 12 would not enter the gutter G. In other embodiments, the downstream end surface 22 is positioned laterally outward from the outer wall OW of the gutter G.

As shown in FIGS. 1 and 2, the upper portion 15 of each vertical fin 14 extends from at least midway along the upper surface 34 of the main plate 12, i.e., from the upstream portion 30 of the main plate to the laterally outward downstream end surface 22 of the main plate. The front portion 16 of each fin extends laterally outward from the downstream end surface 22 of the main plate, and structurally interconnects the upper portion 15 of each fin with the corresponding lower portion 18 of each fin positioned below the plate 12. The top surface 35 of each fin 14 is spaced substantially from the main plate, preferably by a vertical spacing of at least one-quarter inch, so that at least one-quarter inch high flow channels 37 are formed between adjacent plates. The front portion 38 of the top fin surface may be inclined or tapered relative to the top surface 34 of main plate 12, so that leaves and debris are less likely to get trapped between the fins 14 and the roof. For the embodiment shown in FIGS. 1 and 2, each of the fins has a front end surface 40 which is generally perpendicular to the main plate.

The front portion 16 of each of the fins includes a laterally outward surface 46. A lower surface 24 is inclined downward and toward the building B, and terminates in a lower edge drop point 28, which as shown in FIG. 1 is the lowermost point on the fin. Rain water thus drops into the gutter G in the area adjacent the drop point 28. The lower portion 18 of each fin includes a building-facing surface 26 which is inclined toward the building and upward toward the main plate 12.

From the above, it should be understood that leaves and other debris from the roof R pass over the top of the spaced apart vertical fins 14, and drop off the front portion 16 of the fins to the ground, completely bypassing the gutter G. As explained further below, water passes in the channels 37 between the fins 14, and by surface tension goes around the downstream end surface 22 of the main plate and back toward the building, finally dropping into the gutter from the area adjacent the lower edge drop point 28.

A particular feature of the invention is the spacing between the vertical fins 14. This spacing between the vertical fins is carefully controlled so that the significant area surface of the sides of the vertical fins functions to return water to the gutter G by capillary action. Referring to FIG. 2, a pair of plates 14A and 14B include parallel facing side surfaces 50 and 52 which define a uniform gap or spacing between the vertical fins. This gap or spacing is controlled to be less than 0.05 inches, and preferably from about 0.04 to 0.02 inches. The substantial thin gap between the vertical fins ensures that water is returned to the gutter due to capillary action. Theoretically, the spacing should be as small as possible to increase the desired capillary and surface tension effect which returns water around the downstream edge surface of the main plate to the gutter. As a practical matter, however, the fins themselves need to have a sufficient thickness to be structurally sound, and accordingly a spacing of at least 0.02 inches between the opposing surfaces of the fins, and preferably from about 0.03 to 0.04 inches, is desired so that sufficiently sized flow channels 37 are provided for transmitting water from the roof R to the gutter G.

Various tests have been conducted with different embodiments of the present invention. It has been determined that a horizontal spacing of more than 0.05 inches between the opposing faces of the fins will not result in any appreciable capillary action functioning to return water to the gutter. By providing the desired gap between the fins 14, there is sufficient flow area for the water to pass between the vertical fins 14 and then into the gutter. This capillary or surface tension action is thus significantly improved by using fins 14 compared to merely using a horizontal curved plate in the manner of the prior art. Tests have indicated that the gutter cover of the present invention is much more efficient at returning water to a gutter, while allowing leaves and other debris to bypass the gutter. Moreover, this desired result is achieved without the inclination or the angle of the main plate being critical. Tests have indicated that the present invention works well to achieve its objectives if the main plate is angled at from 5° to 45°. In most applications, the main plate 12 will be angled at from about 10° to about 30° relative to a horizontal surface.

As shown in FIG. 1, each unitary or monolithic fin 14 includes an upper portion, front portion, and bottom portion. Each portion of the fins preferably has a uniform width, so that a uniform gap is formed between adjacent fins. This uniform gap thus starts with the entry mouth into the upper portion of the fins, and continues through the front and lower portions of the fins. The fins may be glued or otherwise fixed to the main plate. In another embodiment, the main plate and the fins may be extruded or molded as a unitary member, then machined to their desired configuration as shown.

Figure 4:
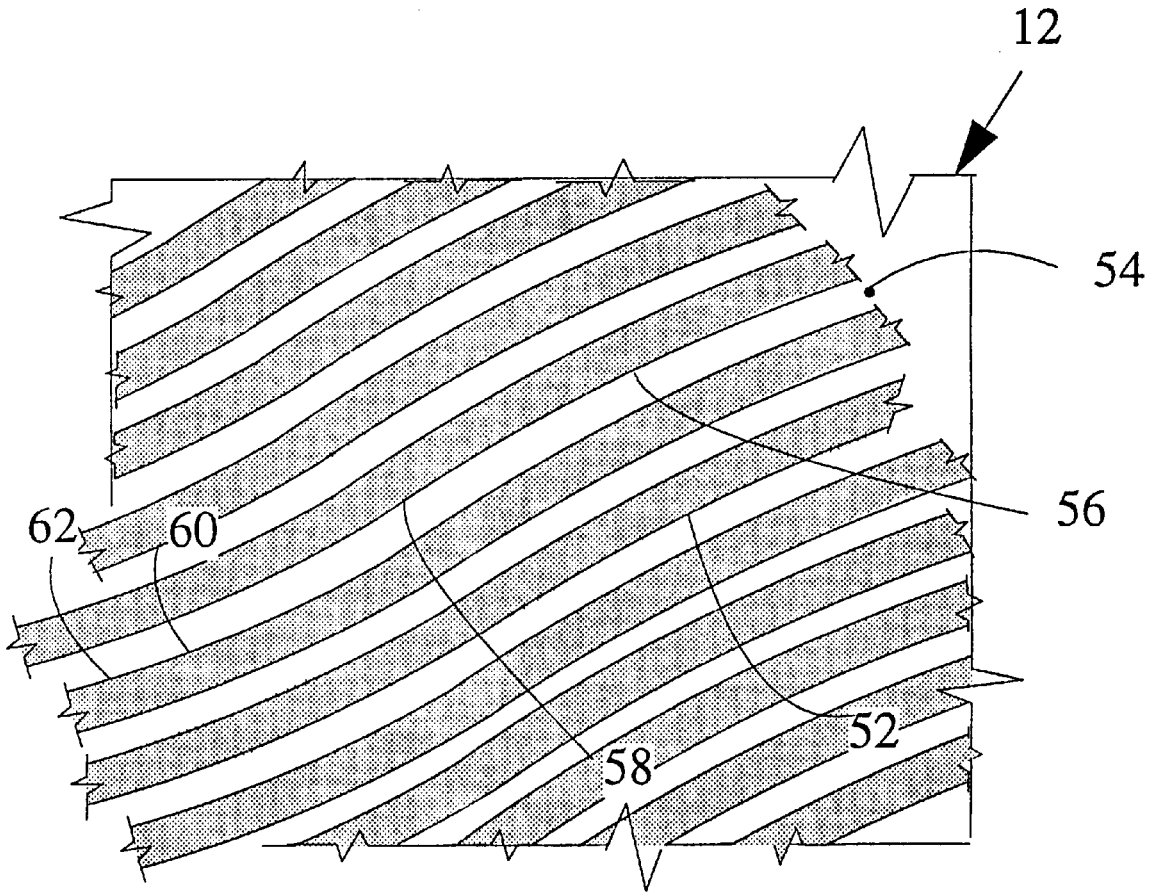
FIG. 4 is a top view of still another embodiment of a gutter cover, illustrating curved vertical fins for slowing the velocity of water passing between the vertical fins and then into the gutter.

As shown in FIG. 2, the upper portion 17 of the main plate and the spacing between the fins provides channels 37 which desirably allow the water to flow in a nonturbulent manner through the channels 37 from above the main plate to around the downstream edge surface 22, and then between the fins 14 to below the main plate, and then drop into the gutter. Each of the fins 14 for this embodiment thus lies within a vertical plane which is perpendicular to the inclined plane in which the main plate 12 lies. In another embodiment, as shown in FIG. 4, the vertical fins 14 include traversely spaced body portions 52. Rain water flowing into the mouth 54 between the vertical fins and downward toward the downstream portion of the main plate thus engage one or more diverting surfaces 56, 58, 60, and 62, which divert the water flow in the channels between the plates and thereby slow down the velocity of water. Alternatively, the main plate 12 could be provided with elongate traverse ribs or raised crowns which extend upward from the otherwise planar top surface 34 of the main plate to slow down the velocity of water prior to reaching the downstream end surface 22.

The top surface of the main plate 12 may have a smooth finish to facilitate smooth and rapid flow of water through the channels 37, or may have a coarse or rough finish to retard fluid flow. If desired, the top surface of the main plate and the sides of the fins may be coated with a suitable polymer, e.g., a Teflon™ or polytetrafluoroethylene coating.

Figure 3:
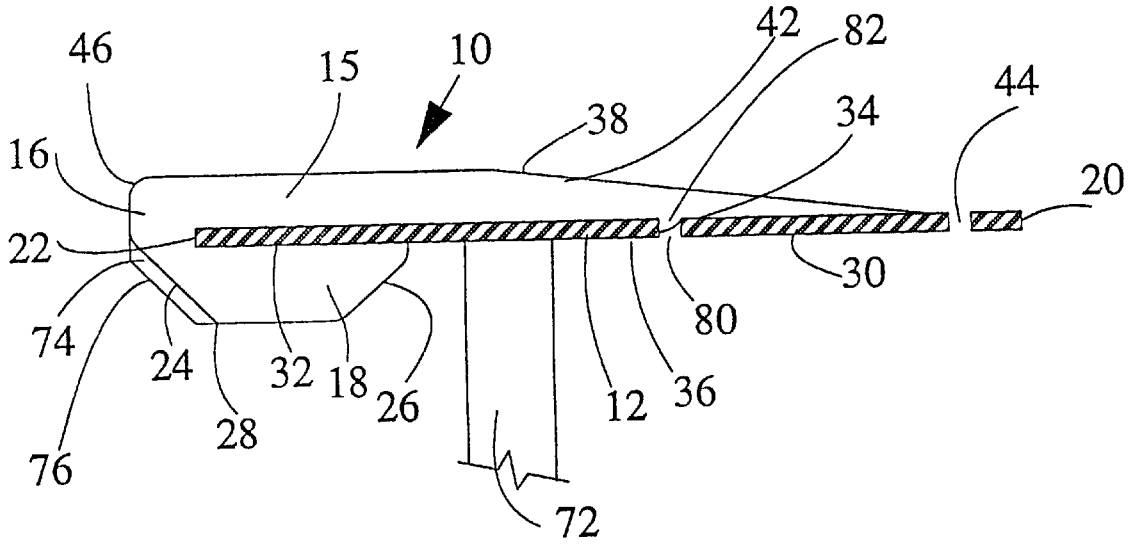
FIG. 3 is a detailed side view of an alternative embodiment of a gutter cover according to the present invention.

Referring to an alternate cover embodiment shown in FIG. 3, it may be seen that the main plate 12 includes a plurality of traversely spaced holes 44 for receiving suitable securing members (not shown) to fasten the upstream portion 30 of the main plate to a roof. Comparing the top portion of the fins 14 shown in FIG. 1 to the fins shown in FIG. 3, the front portion 38 of the top fin includes an extension 42, so that the inclined tapered surface extends into engagement with the top surface 34 of the main plate. Also, the embodiment as shown in FIG. 3 includes a plurality of traversely spaced holes 80 in the main plate each for receiving a respective downwardly projecting clip portion 82 on each fin. The fins 14 may thus be slid into place on the plate 12, as shown in FIG. 3, with the clip portion 82 of the fin falling within a respective hole 80 to lock the position of the fin in place.

Figure 5:
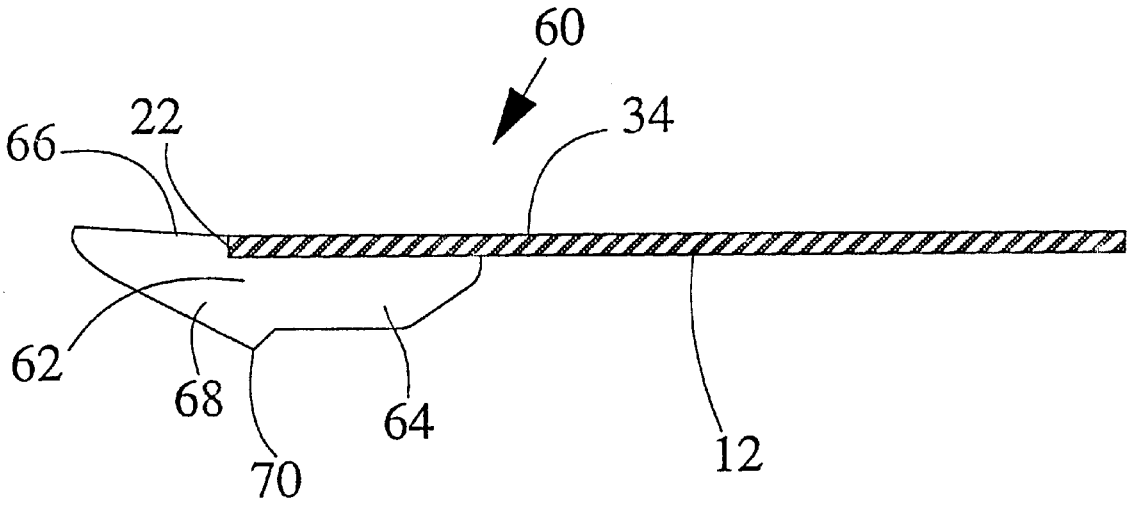
FIG. 5 is a detailed side view of another version of a gutter cover according to the present invention.

FIG. 5 depicts another embodiment of the present invention. The rain gutter cover 60 includes main plate 12 as shown in FIG. 3. Each of the fins does not include an upper portion, and instead includes only a modified front portion 62 extending laterally outward from the downstream end surface 22 of the main plate, and a lower portion 64 positioned below the main plate. The upper surface 66 of each fin may extend from the top surface 34 of the main plate to the curved downward lower surface 68 which is inclined downward and toward the building. The upper surface 66 may in cross-section have an inverted or convexly curved configuration to cause water which engages the top surface of the fin to quickly move traversely and fall into a gap between fins, and not to drop over the lateral edge of the fin. The front portion of the fins and thus the length of surface 66 may also be laterally extended to further ensure that water passes into the gaps between the fins, and is thus transmitted by surface tension toward the building for dropping into the gutter. For the FIG. 5 embodiment, rain water and leaves thus engage the top surface of the plate 12. Leaves and other debris pass along the top surface 66 of the fins 62 and drop to the ground, while water flows in the controlled gaps between the fins 62 and around the downstream end surface 22 then toward the building. A lower edge 70 may optionally be provided on the fins, which serves a function similar to the lower edge surface 28 as shown in FIG. 3. The elimination of the top surface of the fins substantially reduces the cost of manufacturing a cover plate.

As shown in FIG. 3, a plurality of traversely spaced posts or legs 72 may be provided for supporting the main plate 12. Each leg 72 may thus extend from the main plate 12 and be positioned into engagement with a bottom surface of the gutter G. In preferred embodiments of the invention, the lower inclined surface 24 of at least most of the fins does not engage the outer wall OW of the gutter, since engagement of the inclined surface of the fins with the gutter may cause water to pass out from between the fins 14 at this point. The downwardly inclined lower edge surface 24 or the modified inclined surface 68 as shown in FIG. 5 is thus important to achieving the desired surface tension effect to return water toward the building for dropping into the gutter. As an alternative, however, a few selected fins may have a lower inclined surface which extends laterally outward from the inclined surface 24, so that this extension 74 results in a surface 76 which may engage the outer wall OW of the gutter, while retaining the inclined surface 24 for the remaining fins spaced from engagement with the gutter. For this embodiment, one out of 50 or more fins in a series of traversely spaced fins may include this extension 74, thereby providing sufficient support for the cover 10 while inclined surfaces 24 of the remainder of the fins are kept from engagement of the outer wall of the gutter.

The material for the gutter G may be any number of plastic or metal materials which are conventionally used for rain gutters. Similarly, the materials for the cover 10 may be metal or plastic. Galvanized steel and aluminum covers have the advantage of high strength and being noncorrosive, but are relatively expensive. Plastic material gutters ideally would be fabricated from material which has a desired structural strength, but is durable and does not deteriorate when exposed for long periods to exterior weather conditions.

Although the invention has been particularly described for use in a rain gutter system, the concepts of the present invention may also be used in other applications for separating a liquid from solid material, including debris, which is contained within the liquid. Accordingly, the gutter shown in FIG. 1 may represent any type of fluid container which receives fluid from the separation plate 10, while solid material drops outside the container. The system of this invention may be used, for example, to separate solid material from water used in a cooling system.

Those skilled in the art will appreciate that the rain gutter cover of the present invention will reliably return rain water to the gutter during a normal rain. During an extreme downpour, the spacing between the vertical fins may not be sufficient to pass all the water to the gutter, and in that event the water may overflow the cover and fall with the leaves to the ground. This is not a significant problem, however, since during those infrequent periods of such a heavy downpour, a conventional gutter system is frequently not able to handle the quantity of water from the roof, so that the overflow of water from the gutter may occur regardless of whether a cover is placed over the gutter.

The foregoing disclosure and description of the invention are thus illustrative, and changes in the cover, the rain gutter system, and the separation system as described above may be made without departing from the present invention. Each of the features shown in FIGS. 3, 4 and 5 may be substituted for or used in conjunction with the embodiment as shown in FIGS. 1 and 2. It will be appreciated by those skilled in the art that various changes in the size, shape and materials of the disclosed embodiments, as well as in the details of the illustrated construction may be made without departing from the scope of the invention, which is defined by the claims.

What is claimed:

1. A separation device for separating a liquid from solid matter carried by the liquid by passing the fluid into a fluid container while the solid matter passes above the fluid container and falls exterior of an outer wall of the fluid container, the separation device comprising:

a solid planar main plate inclined for receiving liquid and solid matter on top of an upstream portion of the main plate such that the liquid and solid matter carried by the liquid pass by gravity toward a downstream portion of the main plate spaced laterally from the upstream portion of the main plate;

a plurality of fins each in engagement with the main plate and spaced traversely along a length of the main plate, each of the plurality of fins including a front portion for spacing laterally outward of the outer wall of the fluid container, a lower portion spaced below the downstream portion of the main plate, an upper portion spaced above at least the downstream portion of the main plate, and a downwardly inclined lower edge surface interconnecting the front portion and the lower portion and directed downward and laterally toward the upstream portion of the main plate;

the front portion, and the lower portion and the upper portion of each of the plurality of fins having a substantially uniform traverse width; and adjacent pairs of the plurality of fins being separated by a substantially uniform traverse spacing of less than 0.05 inches between sides of adjacent pairs of fins, such that the liquid passes over a downstream edge of the main plate in gaps between adjacent pairs of fins and toward the fluid container by surface tension with sides of the plurality of fins while the solid material passes over the front portion of the plurality of fins and falls below the outer wall of the fluid container.

2. The separation device as defined in claim 1, wherein the uniform spacing between adjacent pairs of fins is from about 0.04 inches to 0.02 inches.

3. The separation device as defined in claim 1, wherein the main plate includes upper and lower planar surfaces each lying within a respective upper and lower inclined plane.

4. The separation device as defined in claim 1, wherein the upper portion of at least some of the plurality of fins includes a traversely varying body portion for retarding the velocity of fluid passing toward the downstream portion of the main plate.

5. The separation device as defined in claim 1, further comprising:

a plurality of legs for supporting the main plate with respect to the fluid container.

6. The separation device as defined in claim 1, wherein the upper portion of each of the plurality of fins is spaced above at least the downstream portion of the main plate.

7. The separation device as defined in claim 6, wherein a top surface of the upper portion of each of the plurality of fins is inclined with respect to a top planar surface of the main plate.

8. A separation device for separating a liquid from solid matter carried by the liquid by passing the fluid into a fluid container while the solid matter passes above the fluid container and falls exterior of an outer wall of the fluid container, the separation device comprising:

a solid planar main plate inclined for receiving liquid and solid matter on top of an upstream portion of the main plate such that the liquid and solid matter pass by gravity toward a downstream portion of the main plate spaced laterally from the upstream portion of the main plate;

a plurality of fins each in engagement with the main plate and spaced traversely along a length of the main plate, each of the plurality of fins including a front portion for spacing laterally outward of both the main plate and the outer wall of the fluid container, and a lower portion spaced below the downstream portion of the main plate, each of the plurality of fins having a substantially uniform traverse width along the longitudinal length thereof; and adjacent pairs of the plurality of fins being separated by a substantially uniform traverse spacing of from 0.04 inches to 0.02 inches between sides of adjacent pairs of fins, such that the liquid passes over a downstream edge of the main plate and in gaps between adjacent pairs of fins and toward the gutter by surface tension with sides of the plurality of fins while the solid material passes by the downstream edge of the main plate and over the front portion of the plurality of fins and falls below the gutter.

9. The separation device as defined in claim 8, wherein each of the plurality of fins includes a downwardly inclined lower edge surface for directing laterally inward toward the fluid container.

10. The separation device as defined in claim 8, wherein a top surface of the upper portion of each of the plurality of fins is inclined with respect to a top planar surface of the main plate.

11. The separation device as defined in claim 8, wherein the upper portion of at least some of the plurality of fins includes a traversely varying body portion for retarding the velocity of fluid passing toward the downstream portion of the main plate.

12. The separation device as defined in claim 8, wherein the main plate includes upper and lower planar surfaces each lying within a respective upper and lower inclined plane.

13. A separation device for separating a liquid from solid matter carried by the liquid by passing the fluid into a fluid container while the solid matter passes above the fluid container and falls exterior of an outer wall of the fluid container, the separation device comprising:

a solid planar main plate inclined for receiving liquid and solid matter on top of an upstream portion of the main plate such that the liquid and solid matter pass by gravity toward a downstream portion of the main plate spaced laterally from the upstream portion of the main plate;

a plurality of fins each in engagement with the main plate and spaced traversely along a length of the main plate, each of the plurality of fins including a front portion for spacing laterally outward of both the main plate and the outward wall of the fluid container, a lower portion spaced below the downstream portion of the main plate, and a downwardly inclined lower edge surface interconnecting the front portion with the lower portion and directing fluid laterally inward of the outer wall of the fluid container, at least the lower portion of the plurality of fins each including the downwardly inclined lower edge surface having a substantially uniform traverse width; and adjacent pairs of the plurality of fins being separated by a substantially uniform traverse spacing of less than 0.05 inches between sides of adjacent pairs of fins, such that the fluid passes over a downstream edge of the main plate and in gaps between adjacent pairs of fins and toward the gutter by surface tension with sides of the plurality of fins while the solid material pass over the front portion of the plurality of fins and fall below the gutter.

14. The separation device as defined in claim 13, wherein the upper portion, the front portion, and the lower portion of each of the plurality of fins have a substantially uniform traverse width.

15. The separation device as defined in claim 13 wherein each of the plurality of fins further includes an upper portion spaced above at least the downstream portion of the main plate.

16. The separation device as defined in claim 15, wherein the upper portion of at least some of the plurality of fins includes a traversely varying body portion for retarding the velocity of fluid passing toward the downstream portion of the main plate.

* * * * *